US005097823A

United States Patent [19]

Kempler

[11] Patent Number: 5,097,823

[45] Date of Patent: Mar. 24, 1992

[54] MECHANICAL DEVICE TO PHYSICALLY MASSAGE AN INDIVIDUAL

[76] Inventor: Martin L. Kempler, 8630 NW. 26th Pl., Sunrise, Fla. 33322

[21] Appl. No.: 532,696

[22] Filed: Jun. 4, 1990

[51] Int. Cl.[5] ..... A61H 7/00

[52] U.S. Cl. ..... 128/60; 128/44; 128/49; 128/55

[58] Field of Search ..... 128/32, 33, 41, 42, 128/43, 51, 52, 60, 61, 44, 48, 49, 54, 55

[56] References Cited

U.S. PATENT DOCUMENTS

| | | | |
|---|---|---|---|
| 710,689 | 10/1902 | Hickey | 128/33 |
| 2,128,790 | 8/1938 | Barbour | 128/52 |
| 3,313,296 | 4/1967 | Ruuska | 128/51 |
| 3,403,674 | 10/1968 | Alimanestiano | 128/61 |
| 3,799,155 | 3/1974 | Gerlich | 128/52 X |
| 4,662,363 | 5/1987 | Romano et al. | 128/60 |
| 4,875,470 | 10/1989 | Cotone | 128/52 X |

*Primary Examiner*—Robert A. Hafer
*Assistant Examiner*—Brian E. Hanlon

[57] ABSTRACT

A device to physically massage a person, the subject lying in a horizontal position and the massaging device positioned over the subject. The massager is comprised of an outer cage in the form of a rectangular cubed structure and an inner carriage in the form of a square frame which is positioned within the cage. The inner carriage, fitted with and mounted on bearings, traverses horizontally toward and away from patient, on guiding tracks, tracks being rigidly mounted in outer cage, this movement being provided by a motor driven crank. The above mentioned carriage assembly houses 4 horizontally-mounted elongated arms, which are rectangular in form, extending out beyond the cage's perimeter and which are raised vertically by a motor driven crankshaft, then dropped by gravity on patient. A spring-assisted adjustable device is incorporated to effect the intensity of the arm drop weight on a patient. The above described massaging apparatus is mounted on an upright cylindrical pipe structure to facilitate its movement in a horizontal oscillating motion by a motor-mounted crank arm.

5 Claims, 12 Drawing Sheets

MECHANICAL DEVICE TO PHYSICALLY MASSAGE AN INDIVIDUAL

TABLE OF CONTENTS

FIELD OF INVENTION
PRIOR ART
SUMMARY
APPLICATION
REFERENCE NUMBERS FOR LOCATING MASSAGER PARTS
BRIEF DESCRIPTION OF THE DRAWINGS
DESCRIPTION OF THE PREFERRED EMBODIMENTS
CLAIMS

FIELD OF INVENTION

This invention relates to a new machine to assist or supplement therapists who do physical massage services in hospitals, health centers, medical offices, and for domestic applications. Due to the fact that it operates on a evenly timed pace, it may enhance the quality of the massage process.

PRIOR ART

| PRIOR ART | | | | |
|---|---|---|---|---|
| Patent # | Date | Description | Serial # | Reference # |
| 2630115 | 11/05/51 | | 254689 | CL128-44 |
| 3672357 | 10/20/70 | | 82427 | CL128-49-44 |
| 3132835 | | Foot Rest | | CL128-D24-36 ? |
| 4565188 | | Vibrator | | CL128-D24-36 ? |
| 3875932 | | Electronic Device | | CL128-24R |
| 3524333 | | Electronic Stimulator | | CL128-24.2 |
| 4136867 | | Vibrating Wheel | | CL128-32 |
| 3672358 | 12/02/70 | | 94416 | CL128-58 |

While most prior art devices in the field of massage are in the nature of electric vibrators, roller wheel apparatus or the various electronics types, or T.E.N.S. types, my invention is a motorized mechanical device which closely duplicates the massaging movements of the therapists palms on the patient.

My invention, being a mechanical device with the ability to work continually at an even pace, may open up new fields in the art of therapeutic massaging and its related fields.

SUMMARY

The main objectives of this device are the following:

1. mechanically massage.
2. tone up the muscles.
3. relieve certain nerve areas.
4. agitate the lung area to control liquid build-up attributed to certain diseases.
5. massage body parts to relieve soreness.
6. generally stimulate local body areas.

The massage arms are positioned over the patient, who is in a prone position. The mechanical massage device consists of a box type outer frame (cage) and an inner frame (carriage). The carriage has four bearing rollers fabricated to it so that it can travel horizontally toward and away from patient on guide tracks which are fastened to the outer frame (cage). This movement is powered by an electric motor.

The inner frame (carriage) also contains four massage arms that extend horizontally out from the carriage frame. These massage arms, by means of a electric motor and connecting crank arms, are raised vertically and then they drop to their rests.

A spring loaded tension bar and lever is incorporated over the massage arms and connected to the arms to control the drop intensity on a patient. Arms are positioned over individual. A quadrant plate locks the tension bar lever in its selected adjustment.

The outer cage frame contains the guide tracks for the inner carriage to traverse on. The outer cage is constructed to hold the inner carriage frame. The outer cage also contains the electric control switches.

The entire device, carriage and cage, is mounted on a swivel plate (turntable) and base. Its purpose is to further the capability of the mechanical massager to move horizontally right and left in an oscillating motion. An electric motor powers this movement. Thus, the massage arms can operate in any direction.

It now gives my device the capability of the massage arms to move vertically up and down, toward and away from the patient, and a right and left oscillating motion.

APPLICATION

The patient is positioned on a plane (bed) in any position that treatment is to be administered. Protruding massage arms are the mechanical massagers front. The massager operator is positioned at the rear of the device (opposite the arms). The final motion of the massage arms, dropping down, works on gravity. The massage device is positioned over the patient and the arms adjusted to just touch the patient. The massaging device is then adjusted slightly lower (½" to 1") so the arms rest lightly and evenly on the patient.

Set tension brake lever adjustment rearward to "L" (light) to bring massage arms in upper position. Put switch A on and motor A will activate and operate massage arms. Carefully release tension brake lever (hold firmly) until massage arms touch the patient, then adjust arms to patient's comfort. Be sure tension brake locks firmly in quadrant after adjustment. This movement simulates the light chopping action of the palm's heel of the therapist.

A horizontal stroking action of the massager arms is achieved by putting switch B on and motor B will activate to cause the carriage to horizontally move toward and away from patient as in a kneading action by the therapist.

Switch C activates motor C which causes the entire cage and carriage assembly to oscillate on a horizontal plane; thus, the massager arms cause a rubbing action on the patient.

Each of the three movements may be operated independently of each other, after initial adjustment of the massage arms, using tension brake lever as described previously. To stop machine after treatment, turn off all control switches to motors, then pull back on tension brake lever to raise massage arms to "light" position. Make sure it is locked in the quadrant. When tension lever is in forward position, massager arm strokes are heavier in weight. When pulled backward strokes are lighter. The tension lever, when pulled extremely back, raises massage arms. Mechanical massager is now removed from bedside after treatment completion.

The mechanical massager is similar in size to a 20" television set and weighs about 100 pounds. Materials:

Aluminum framing and bronze bushings at friction points. Measurements are not required to be exact.

REFERENCE NUMBERS FOR LOCATING MASSAGER PARTS

1. Outer cage.
2. Carriage track guide.
3. Motor B for reciprocating, carriage 20 movement toward and away from subject.
4. Crank arm pulley for carriage 20 movement.
5. Carriage to motor tie bar.
6. Carriage retainer plates (2).
7. Motor's control switches (3) and mounting plate
7A. Indicator light.
8. Motor C for oscillating cage and carriage 20 assembly movement (similar to an electric fan).
9. Crank arm pulley for massager oscillating movement.
10. Oscillator tie bar.
11. Oscillator anchor bar.
12. Cage mounting plate, attached to inner columns (swivel).
13. Stand outer pipe column.
14. Height adjusting lock pins.
15. Massager carrier base assembly (wheels, etc.).
16. Carrier assembly handle.
17. Electrical multi-plug outlet bar.
18. Micro switch to automatically stop oscillating cage and carriage assembly in center position when massage is turned off.
19. Safety control switch—stops all electric current to mechanical massager.
20. Inner carriage.
21. Carriage bearing rollers for track guides 2.
22. Motor A and pulleys for driving massage arms 26.
23. Massage arms 26 crank shaft and pulley.
24. Massage arm crank arms (4).
25. Crank to arm bearings.
26. Massage arms—positioned apart by spacer sleeves on fulcrum shaft 27.
27. Fulcrum shaft for massage arms 26.
28. Arm alignment guides—1 for each massage arm 26.
29. Brake bar bracket (2).
30. Tension brake bar.
31. Angle bracket, extension plates and spring assemblies, one for each massage arm 26.
32. Tension brake lever, lock pin and lock pin spring to lock lever in selected position on quadrant 33.
33. Quadrant.
33A. Quadrant support brace.
34. Tension brake assembly 30 reinforcing brace bar.

BRIEF DESCRIPTION OF THE DRAWINGS

A better understanding of the invention and its embodiments will be achieved by referring to the numbered characters and drawings. A new device, the mechanical massager, is constructed in accordance with the teachings of the present invention, is now illustrated.

Figure 1:
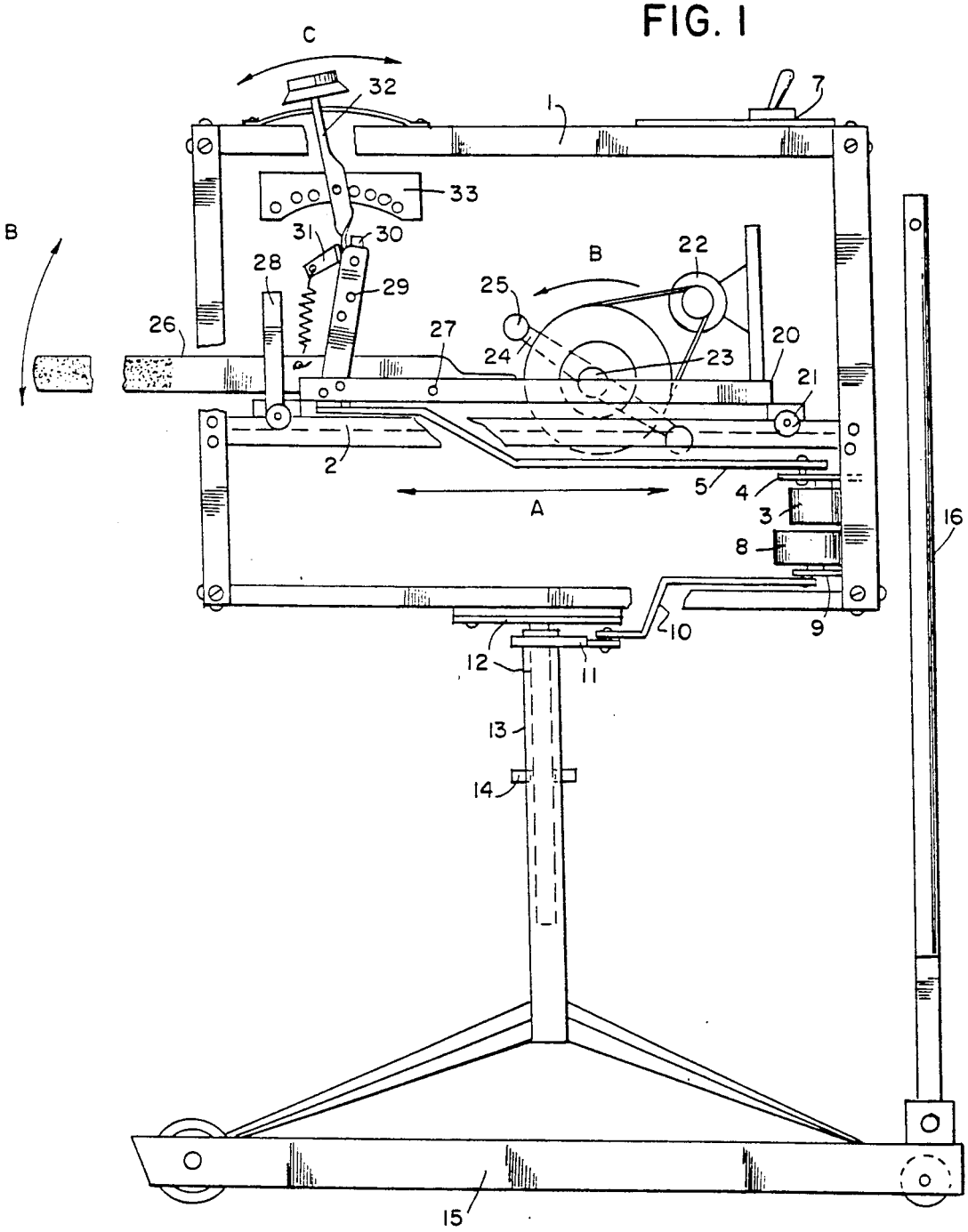
FIG. 1
Figure 2:
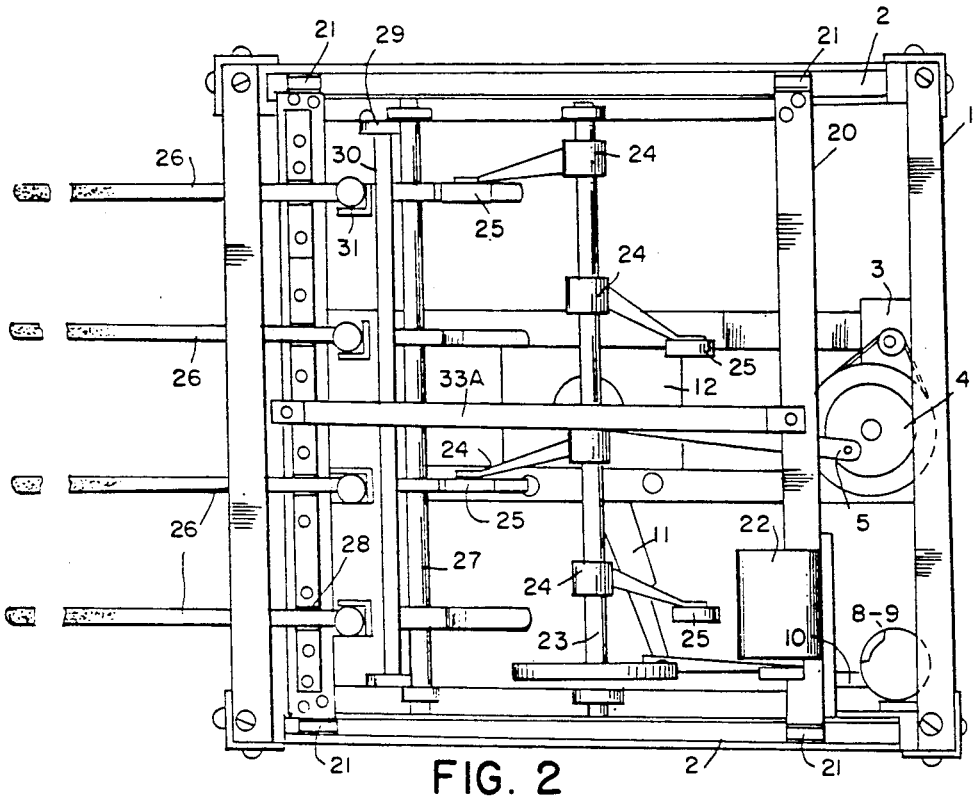

General right side view of complete mechanical massager showing carrier base 15, adjustable outer column 13, for height and adjustment lock pins 14, and a simplified drawing of the massager cage 1 and carriage 20 assembly. (Quadrant support brace 33A is omitted for clarity.)

The cage 1 contains the carriage assembly 20. The carriage 20 rides on bearing rollers 21, on track guides 2, track guides being fabricated in side frame of cage. It is propelled forward and backward on a horizontal plane by means of a electric motor 3, rotating an attached crank arm pulley 4, which is pivot bolted to tie bar 5, that is connected to carriage 20. (Note directional arrows A in FIG. 1.)

Massage arms 26 mounted in carriage 20 are raised by means of crank arms 24 mounted on crank shaft 23, which is driven by an electric motor 22, through pulleys and belts. (Note directional arrows B.)

Tension brake assembly 30 is adjusted by tension brake lever 32, which has lock pin 32 in it that fits into any of the various holes in the quadrant 33 which is rigid. Brake lever 32 through angle bracket 31 and tension pull springs 31, are attached to massage arms 26. Massage arms are only lifted by its crank arms 24 but drops by gravity. Massage arms 26 are mounted on a fulcrum shaft 27. (Note directional arrow C in FIG. 1.)

The mechanical massager cage assembly is mounted on plate 12 and inner swivel column 12. Base 15 supports the cage 1 and all its components.

The cage 1 assembly oscillates horizontally by means of an electric motor and attached crank arm pulley 9. The revolving crank arm pulley 9 moves oscillator tie bar 10, which is pivot bolted to anchor bar 11, which is rigid on stand outer column 13.

FIG. 2

Top view of massage assembly showing cage 1 that supports inner carriage 20 and some carriage 20 details of massage arms 26 drive parts. Quadrant support base 33A is present in this figure.

FIG. 3

Figure 3:
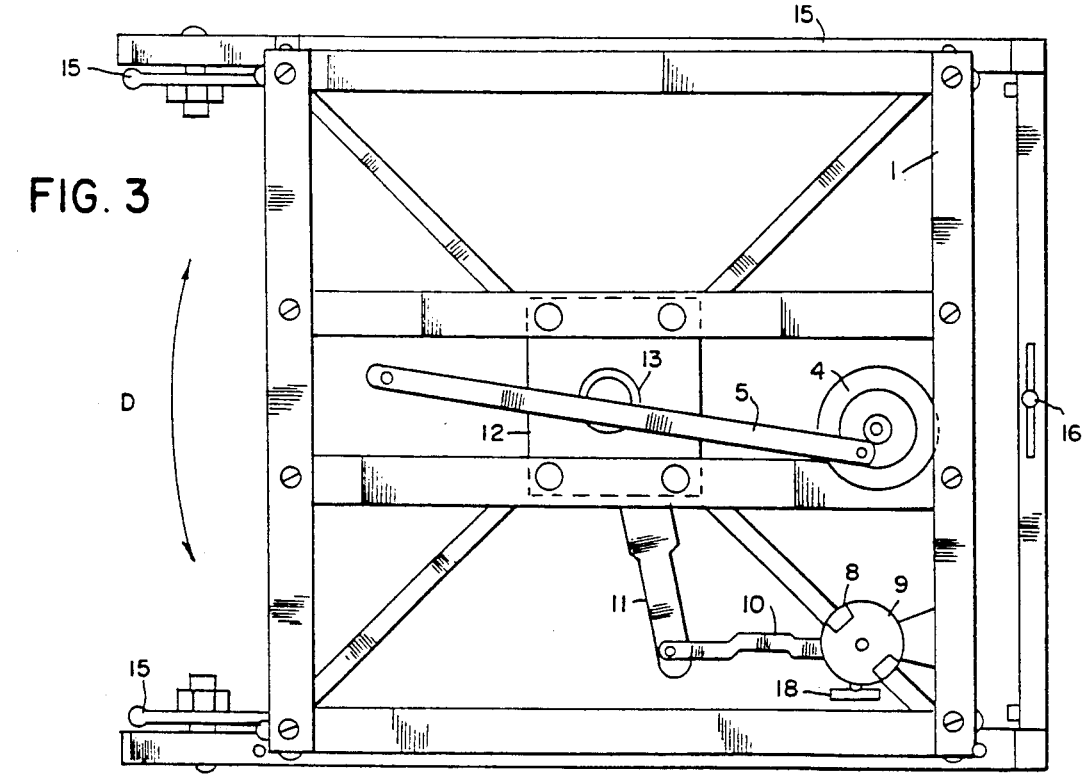
Figure 4:
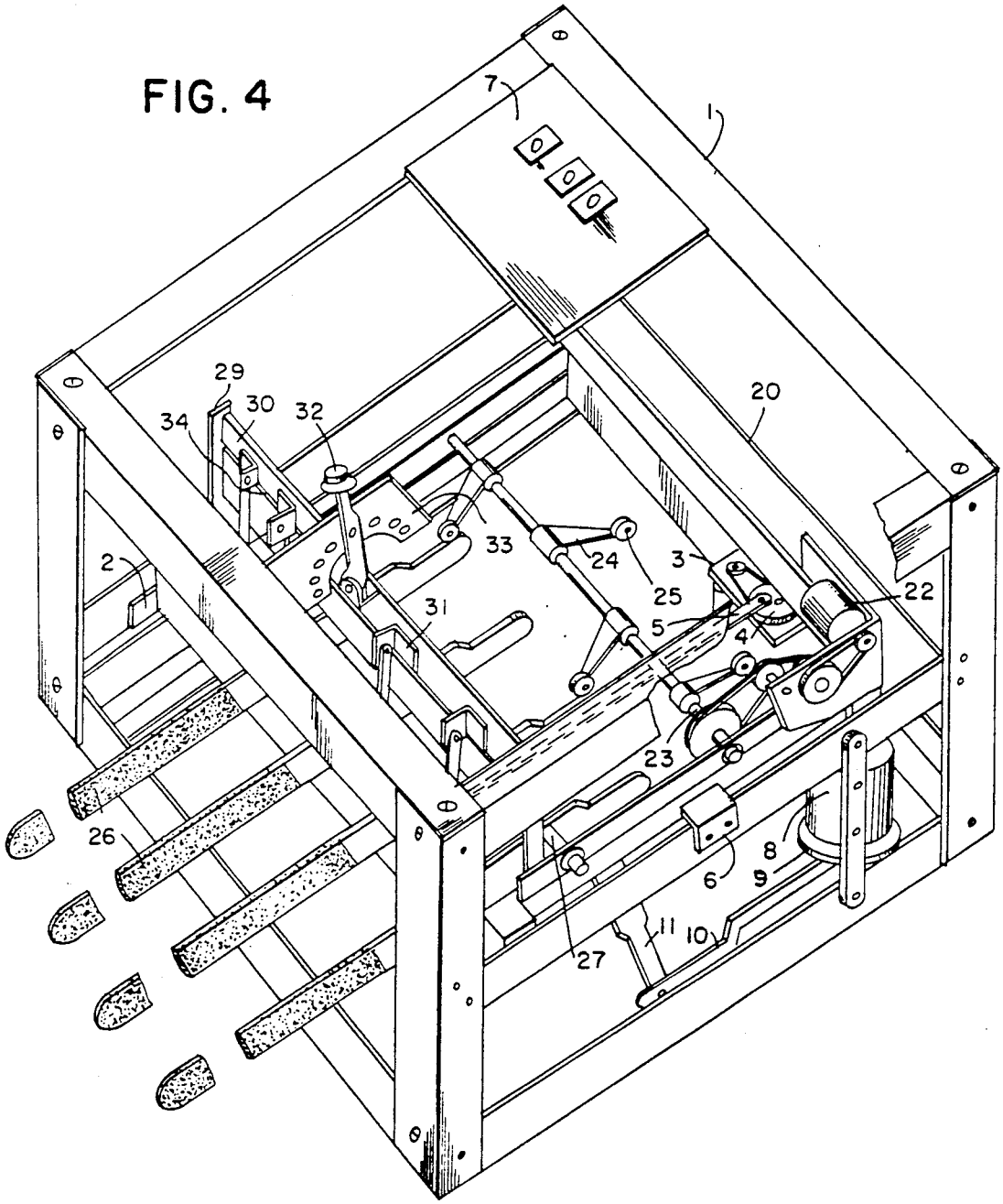

Top view of lower cage 1 (carriage 20 omitted) shows tie bar 5 which connects to carriage 20. Oscillator connecting gear is shown 8, 9, 10, 11. Outer outline is edge of carrier base 15 and pull handle 16. (Note directional arrow D in FIG. 3.)

FIG. 4

Right side oblique view of entire mechanical massager, less base assembly 15. (Quadrant support 33A is omitted for clarity.) Motor control switches 7 and plate 7 is shown. Refer to text of FIG. 1 for reference.

FIG. 5

Figure 5:
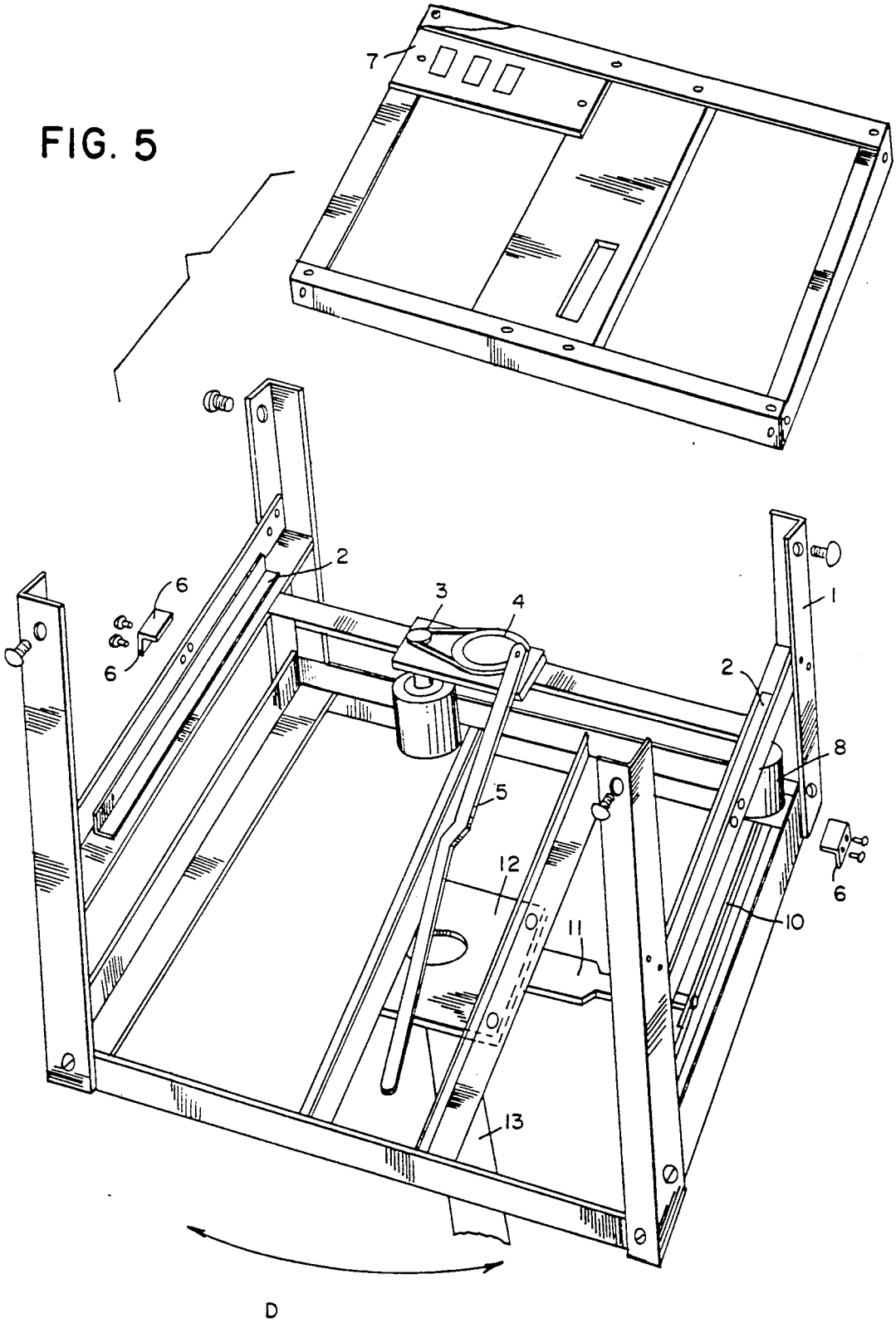
Figure 6:
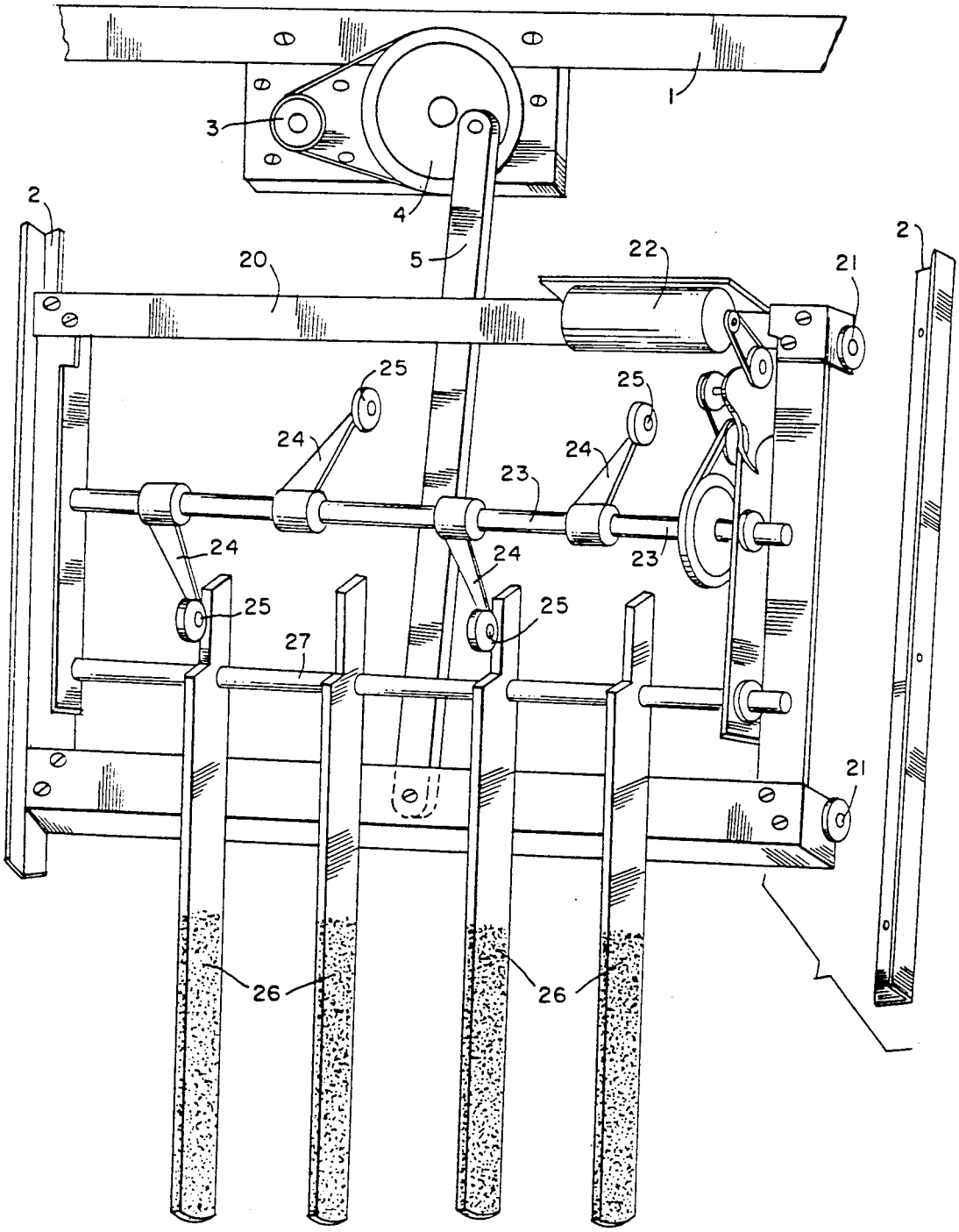
Figure 7:
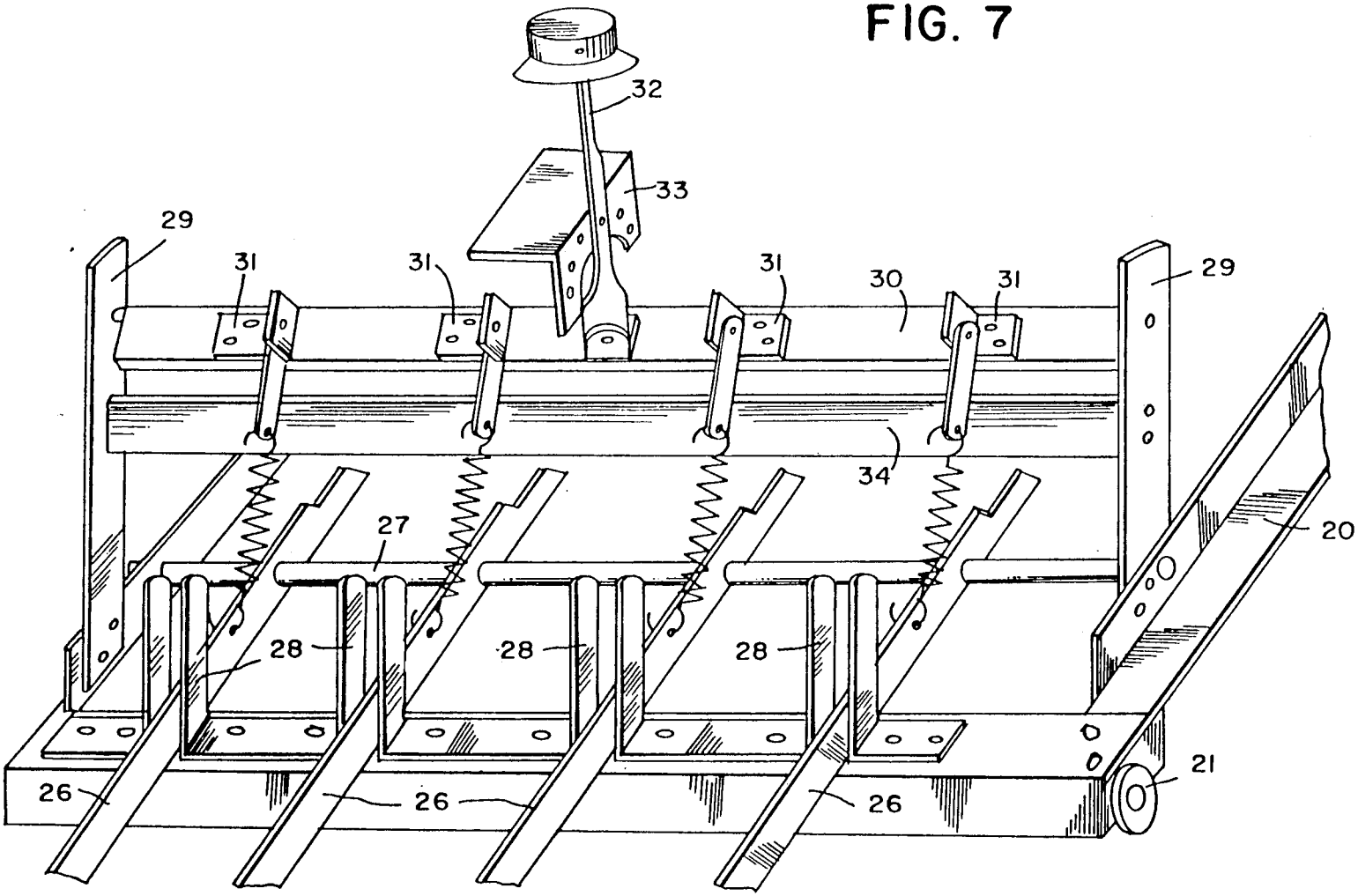
Figure 8:
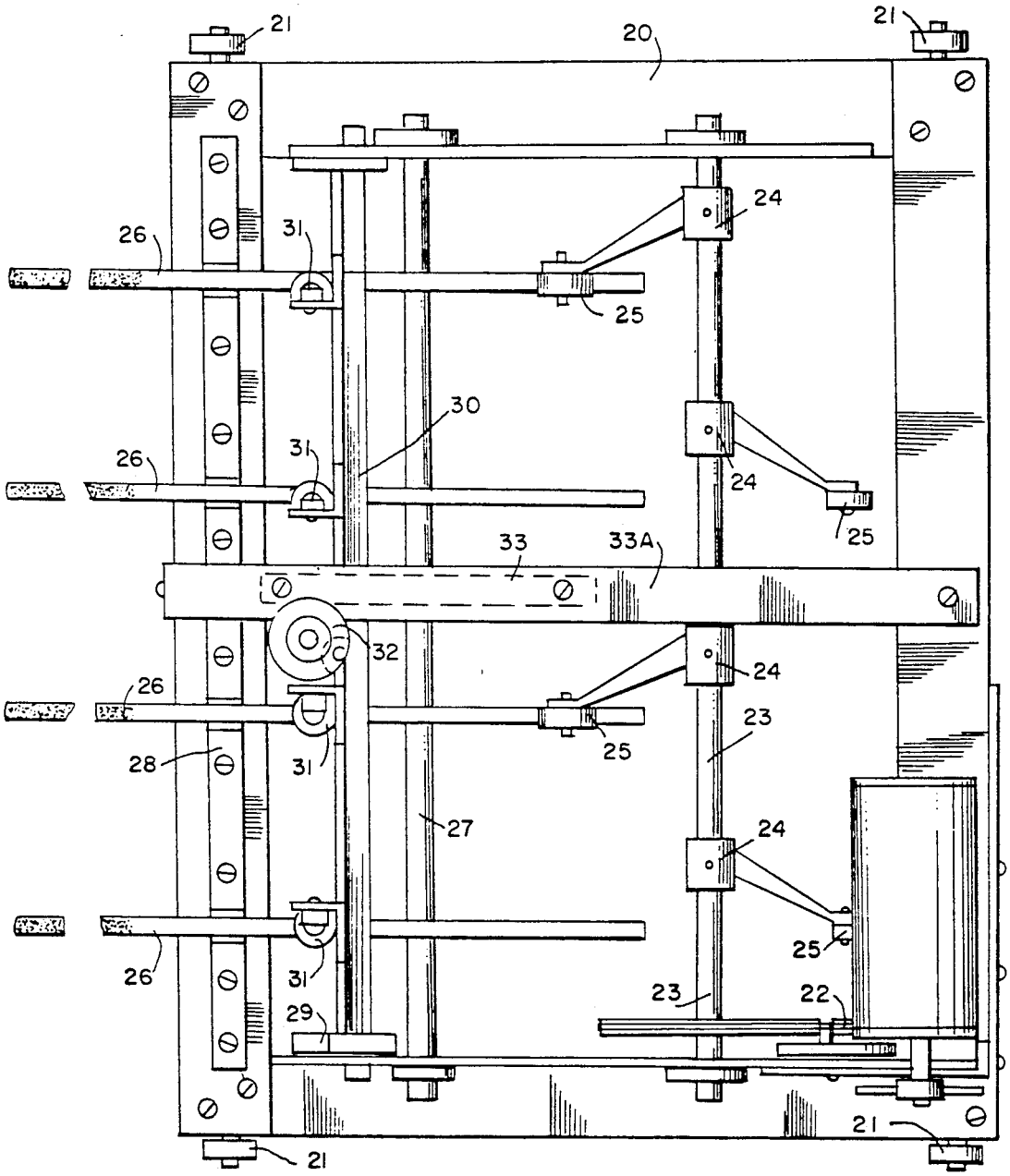

Full oblique frontal view of massage cage 1 with top separated. Track guides 2 are fabricated to cage side rails (1 on each side). Carriage retainer plates 6 are shown. Cage mounting plate 12 and column 13 can be seen. (Note directional arrow D in FIG. 5.)

FIG. 6

This simplified oblique drawing of the top view of carriage 20 shows how it mounts on the track guides 2. Also, the connection of tie bar 5 to carriage 20 from motor 3. Massage arm 26 raised by crank shaft 23 and crank arm 24 are detailed.

FIG. 7

The oblique enlarged right front abbreviated details of the tension brake assembly, mounted over the massage arms 26, on the carriage 20. Quadrant 33 is located over brake bar 30 and tension brake lever 32. Tension lever lock pin 32 penetrates indexed holes in quadrant 33 to lock selected massage arm 26 adjustment. Note massage arm guides 28. Note bearing rollers 21.

FIG. 8

Enlarged top view of complete inner carriage 20. (Cage 1 has been omitted for clarity.) Massage arms 26 are 24" in length. Crank arms 24 are staggered 180°, so that two arms 26 alternately are raised at a time. Massage arms 26 pivot on fulcrum shaft 27.

FIG. 9

Right side view of complete inner carriage 20 (slightly enlarged). (Cage 1 is omitted for clarity.) Side view of tension brake assembly is detailed (parts 30, 31, 32, 33, 33A). Location of the carriage 20 bearing rollers 21 is shown. Massage arm 26 driving detail from motor 22 and pulleys to arm contact bearing 25 is detailed.

FIG. 10

Figure 9:
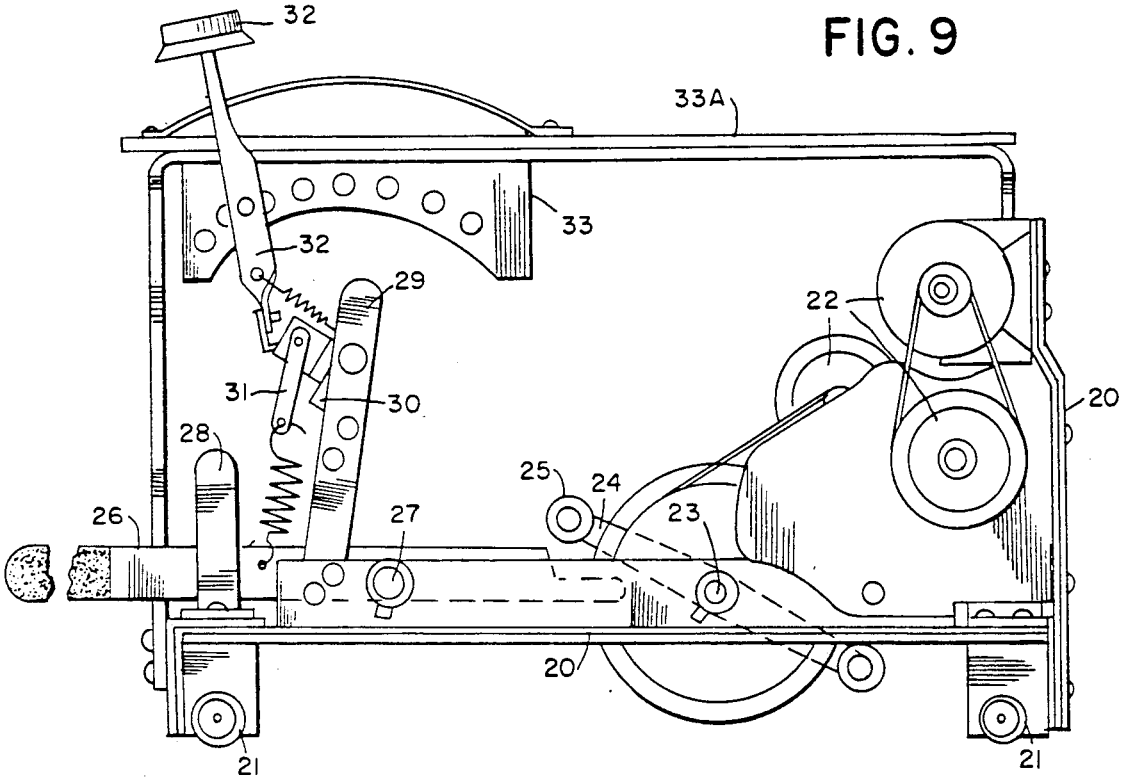
Figure 10:
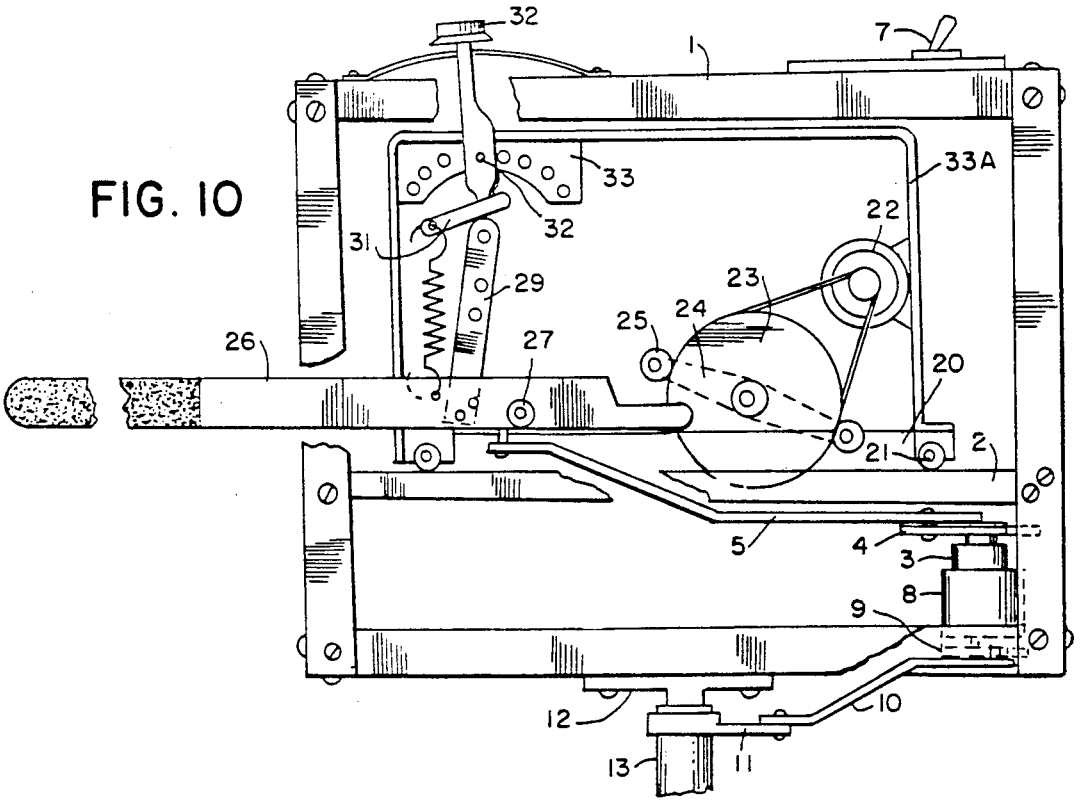

This right side view is a simplified drawing of the carriage 20 in FIG. 9 but is mounted in its cage 1. Control switches 7 and plate 7 is mounted on top rear of cage 1. Mounting plate 12 and inner pipe column 12 swivels in outer pipe column 13. FIG. 10 is similar to drawing of massager in FIG. 1.

FIG. 11

Figure 11:
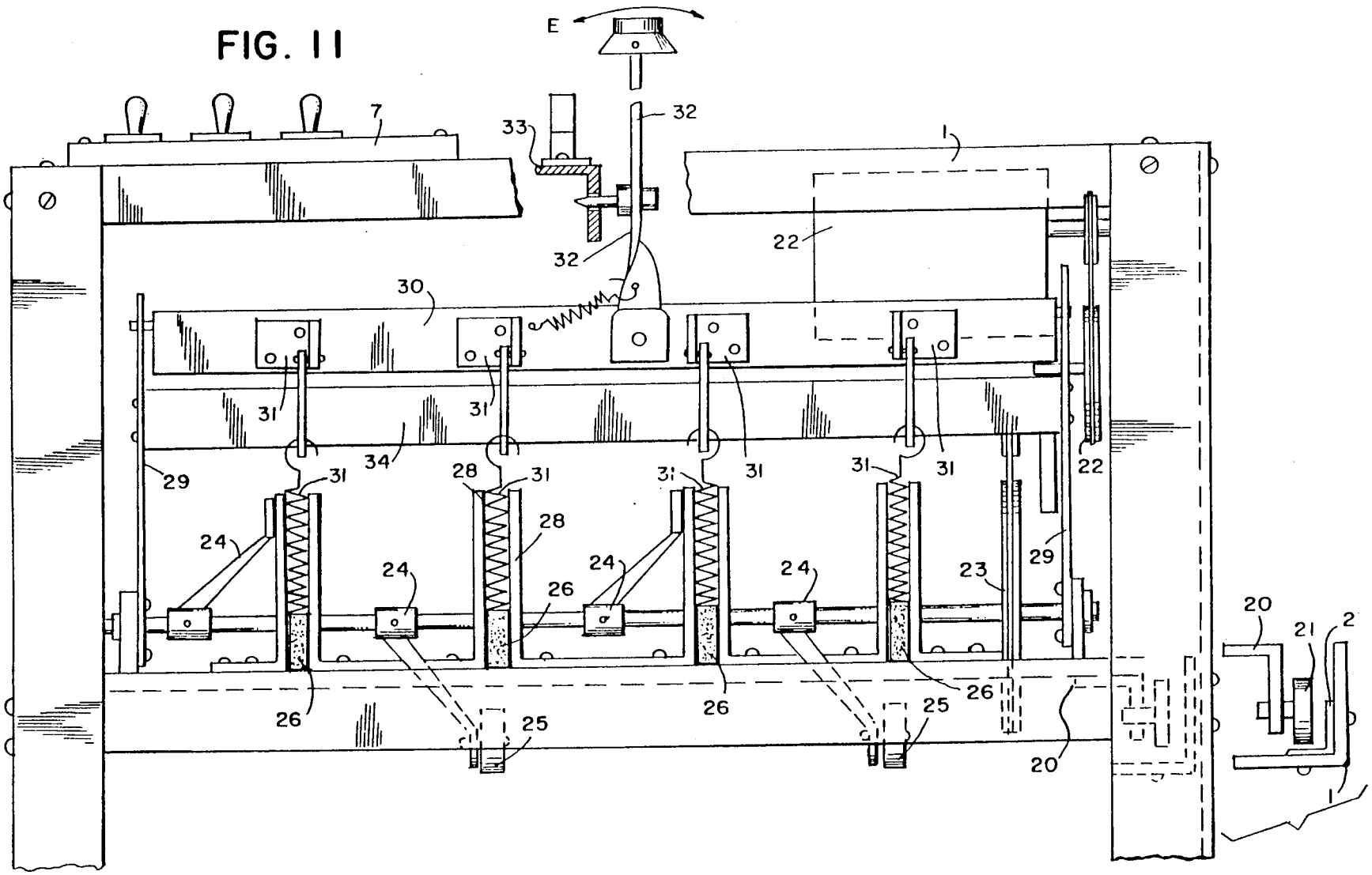
Figure 12:
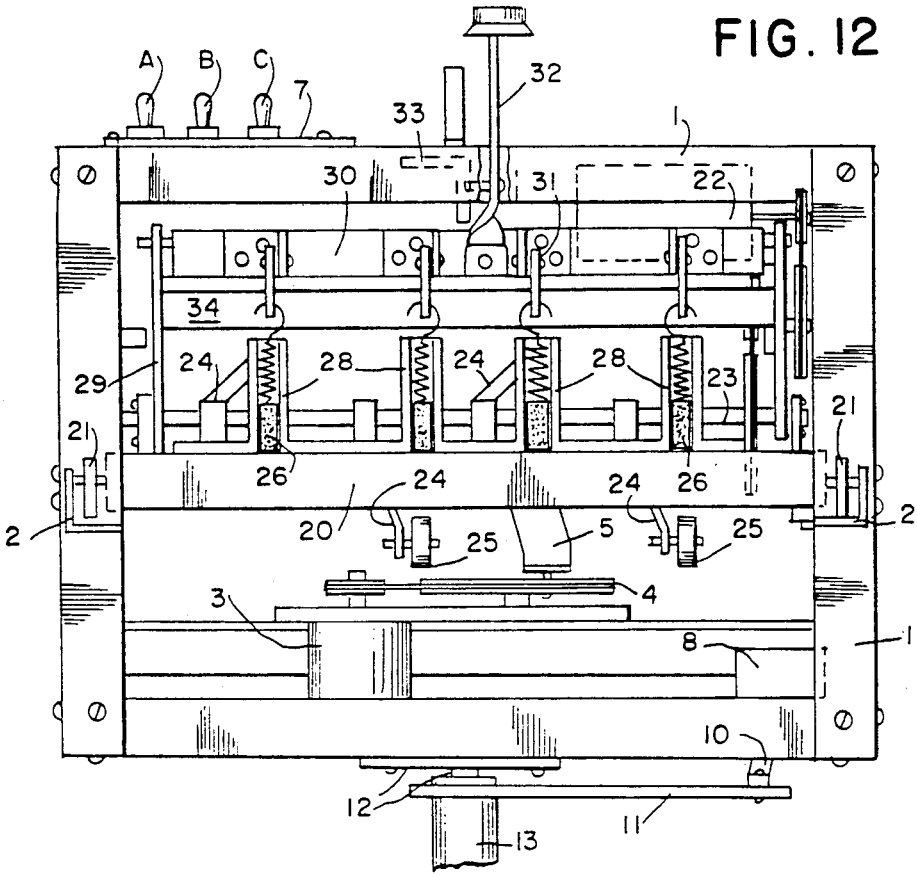
Figure 13:
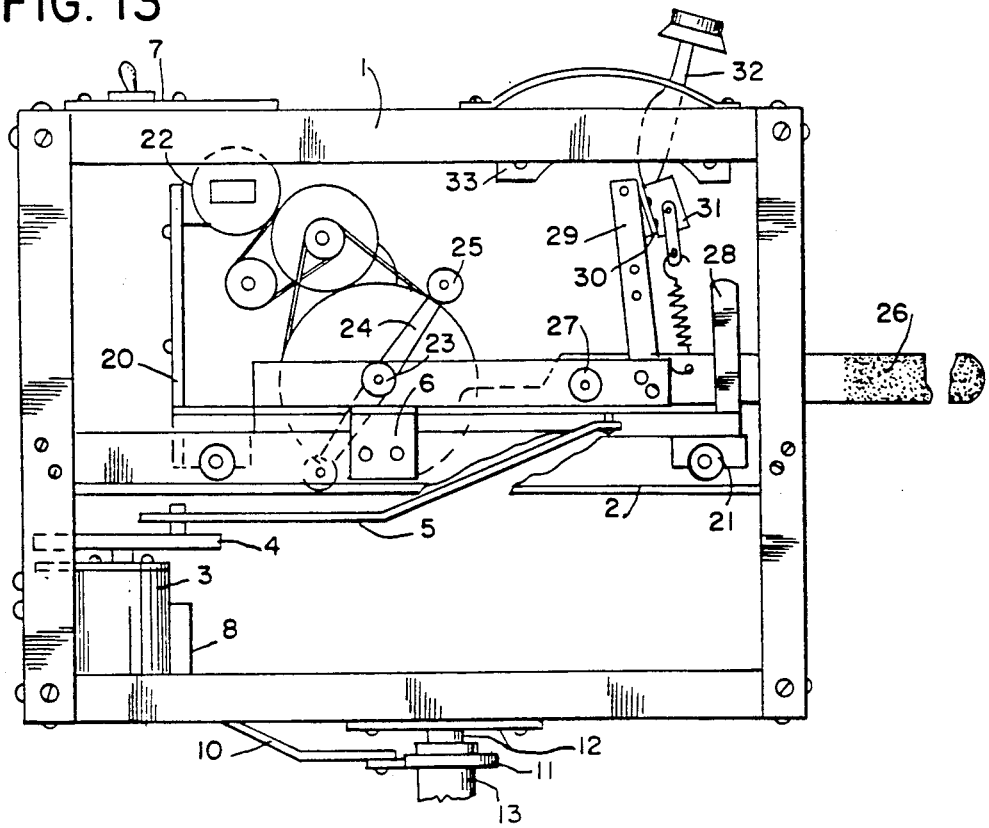
Figure 14:
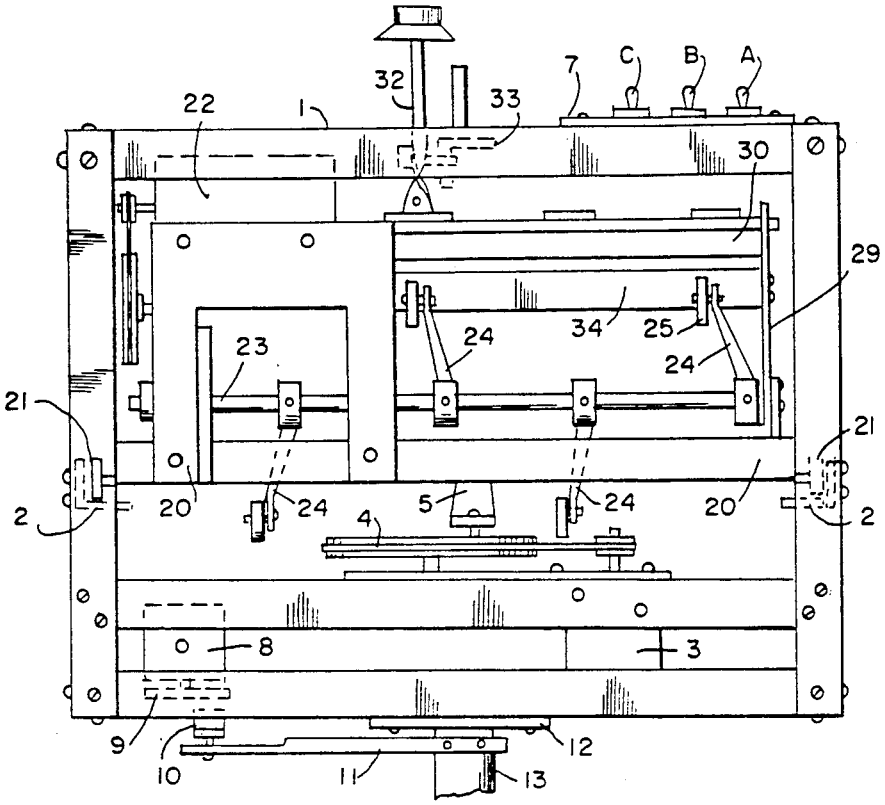
Figure 15:
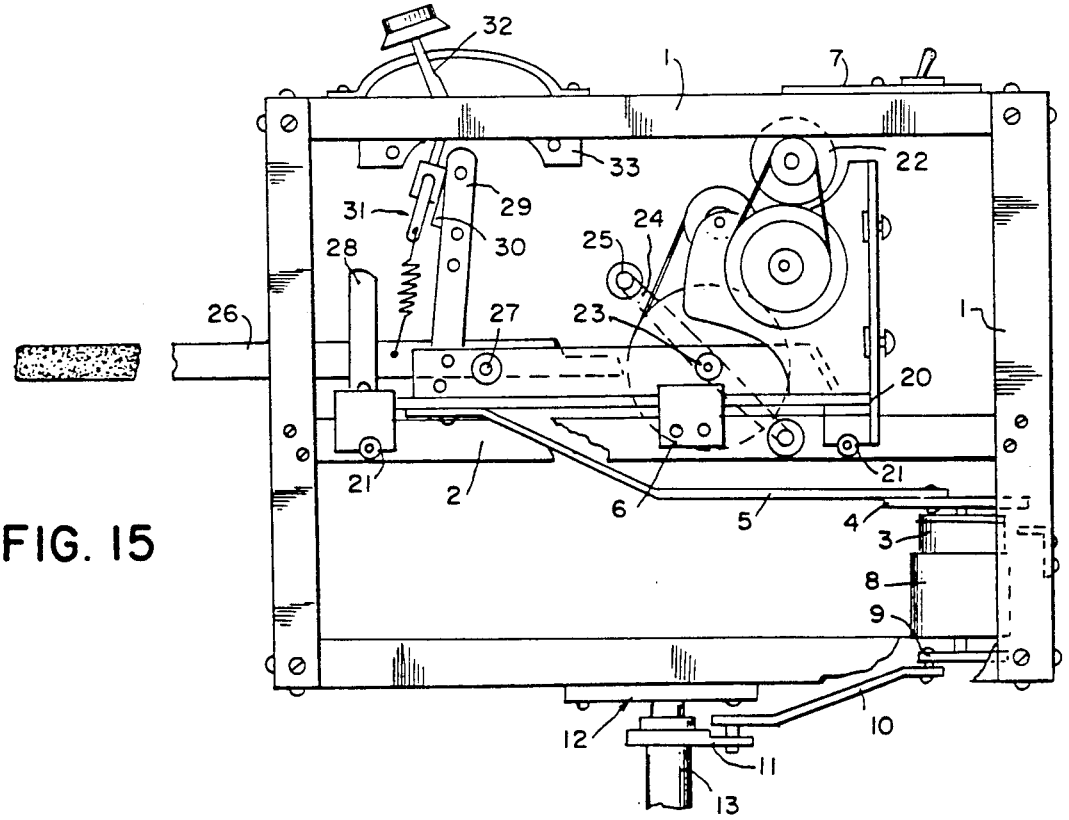

This enlarged frontal drawing is $\frac{1}{2}''=1''$ scale. It shows the carriage 20 and a section of cage 1. Details of the tension brake lever 32, attached lock pin 32, and pull back spring 32, which holds lock pin firmly in quadrant 33 indexed hole. (Note directional arrow E in FIG. 11.) Angle brackets 31, extension plates 31, and tension springs 31 connected to arms 26 are detailed. Right side of drawing shows details of bearing rollers 21 which rides on track guide 2 which is mounted in cage 1.

FIG. 12

Frontal view of massager assembly. Scale is $\frac{1}{4}''=1''$. It shows location of various components. Notable are the electric motors 3 and 8 in lower cage 1.

FIG. 13

Left side view of massager assembly. Scale is $\frac{1}{4}''=1''$, shows location of various components. Carriage 20 retainer plates 6 is fastened to mid-cage 1 frame support. It keeps the carriage 20 in its position as it traverses. One plate is on each side of cage 1.

FIG. 14

Rear view of massager assembly. Scale is $\frac{1}{4}''=1''$, shows location of various components. Note location of motor 22, mounted in carriage 20. Motors 3 and 8 are mounted to the rear of the cage 1. Plate 7 with the 3 control switches 7 are located on top of cage 1.

FIG. 15

Right side view of massager assembly. Scale is $\frac{1}{4}''=1''$. It shows location of various components. Drawing is similar to FIG. 10.

FIG. 16

Although it is not an essential part of the inventive process, this drawing may be necessary to explain the wiring of the three modes to operate the mechanical massager. Current supply travels to multi-plug outlet bar 17. Before reaching bar 17, current is diverted through a safety control switch 19. This switch shuts down all electric power to massager. Current is then channeled to the three motor control switches 7. Switch 7 A activates electric A motor 22, which operates massage arms 26. Switch 7 B activates B motor 3, which operate traverse movement of carriage 20 assembly. Switch 7 C activates C motor 8 which operates the oscillating movement of the entire massaging device. Micro-switch 18 keeps entire massager assembly in the oscillating mode running, until it is centered on base 15, then it shuts power off to motor 8, after main power is shut off by switch 7 C.

DESCRIPTION OF THE PREFERRED EMBODIMENTS

This device is a box type outer frame, cage 1. It houses a inner frame, carriage 20. The carriage 20 is the part that does most of the intended work of the mechanical massager. It supports the 4 massage arms 26 that are raised by A motor 22, and then they drop by gravity to their rests. The carriage 20 has 4 bearing rollers 21 at its base to facilitate a horizontal forward and backward motion on guide tracks 2. Guide tracks 2 are fabricated to outer cage 1. Retainer plates 6 holds carriage 20 firmly in track guide 2.

An adjustable tension brake bar 30 and lever 32 assembly to adjust massage arm 26 drop weight is incorporated in the carriage 20 over the massage arms 26. The tension lever 32 locks it in selected position by a quadrant 33 shaped metal plate with holes indexed in it. The tension brake lever 32 has a lock pin in it to penetrate the selected hole in quadrant 33.

The outer cage 1 frame is the supporting member for the carriage 20. It contains the track guides 2 for the carriage 20 to traverse on.

It houses the B motor 3 and related parts to propel the carriage 20 to and fro. It also houses the C motor 8 to facilitate its horizontal oscillating motion. The cage 1 assembly is mounted on a base stand assembly 15. The electric control panel 7 is mounted on top of cage 1. It contains three switches 7 to control the motors for the three modes of operation.

MODE 1

A switch 7 controls the power for the massage arms 26. A motor 22 which is mounted on the carriage 20 through reduction belts and pulleys, rotates the crank shaft 23 at 30 R.P.M. Crank shaft 23 has four crank arms 24 fitted on it. Crank arms 24 are positioned, alternatively, two at 180° from the other two, so that two massage arms 26 at a time are raised then dropped by gravity to contact patient every $\frac{1}{2}$ revolution of rotating crank shaft 23. Crank arms 24 are tipped with bearings 25. Massage arms 26 pivots on fulcrum shaft 27. Massage arms 26 slides up and down in aligning guides 28.

The intensity of the arm 26 drop is regulated by the tension brake 30 assembly which is located directly over the massage arms 26. Tension brake bar 30 is supported on either side by brackets 29 and reinforcing bar 34. Tension brake bar 30 is fastened to tension control lever 32. Tension lever 32 is fitted with a lock pin 32, which fits into any of the indexed holes in the quadrant 33 to achieve a massage arm 26, drop, intensity adjustment. The quadrant 33 is rigid on support brace 33A. (A small spring 32 keeps tension on the brake lever lock pin 32.) Pulling tension lever 32 back raises arms 26 which is connected to tension brake bar 30 by springs 31, extension plates 31, and angle brackets 31.

MODE 2

B switch 7 controls the power for the movement of the carriage 20, motor 3. Motor 3 is mounted in the lower rear part of cage 1. As activated B motor 3 and attached crank arm pulley 4 rotates, it moves tie bar 5 which connects to carriage 20, causing it to move back and forth horizontally on the track guides 2. Two retainer plates 6 which is attached to cage 1 side rails, holds the carriage 20 bearing rollers 21 in contact with the track guides 2 in cage 1. The carriage 20, traverses 14 times per minute, at a stroke length of $2\frac{3}{4}''$. B motor 3 has its speed reduced throughout a gear reduction box.

MODE 3

C switch 7 controls the power to the C motor 8 mounted in the lower rear part of the cage 1. Motor 8 through a reduction gear box oscillates the complete massager assembly at the rate of 6 times per minute right and left on a horizontal plane and deviates 10° from a center point. Rotating motor 8 and crank arm pulley 9 is connected by oscillator tie bar 10 to anchor bar 11 which is rigidly mounted to the outer pipe stand 13. The whole cage 1 assembly is fastened on a mounting plate 12, which is fabricated to the inner column 12, that swivels inside the outer pipe column 13. The whole device is mounted on carrier base assembly 15.

Figure 16:
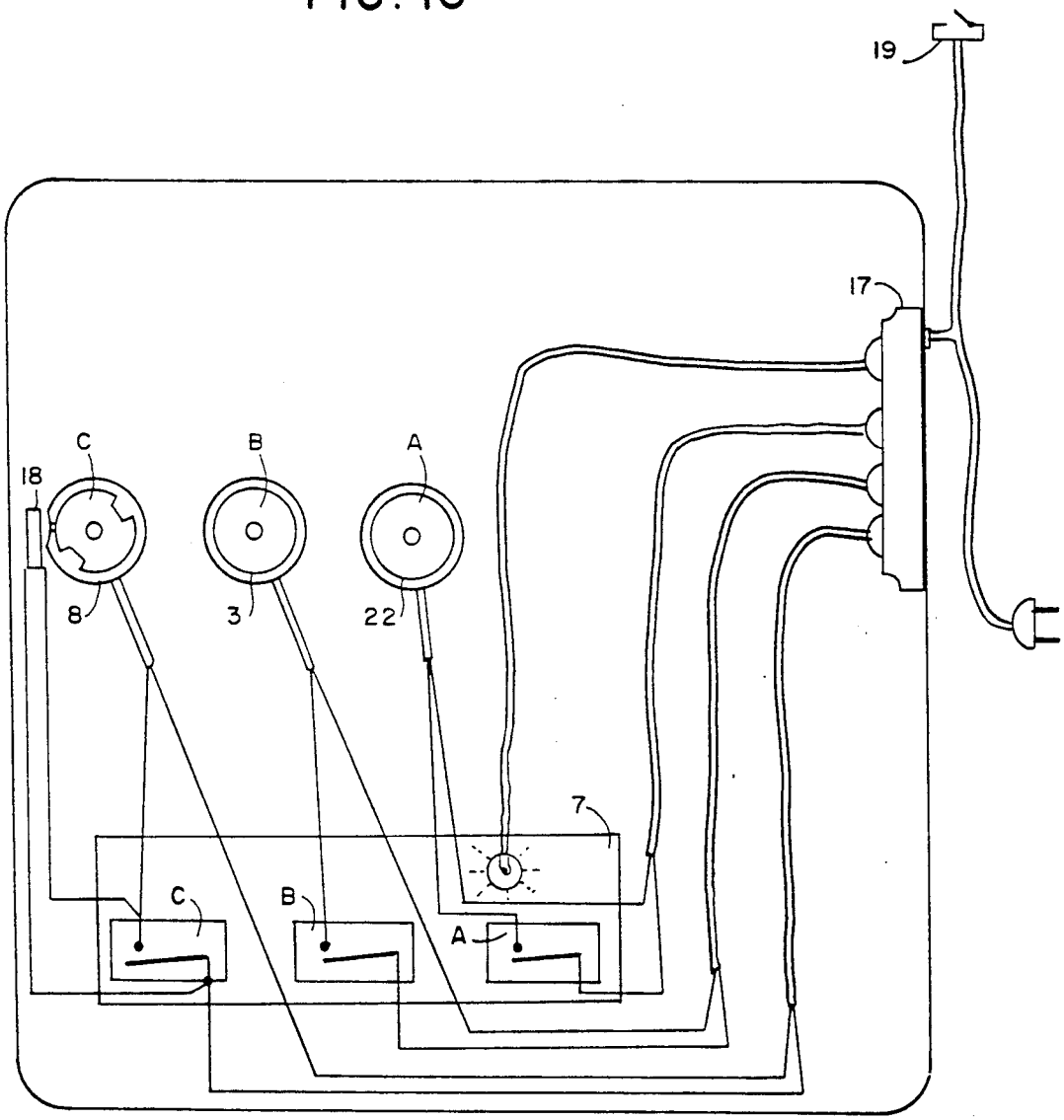

Carrier 15 and pull handle 16 is shown in FIG. 1. Massage height is adjusted by releasing lock pins 14. Electric portions are described in text of FIG. 16.

The foregoing description to the preferred embodiments of the invention has been presented for the purpose of illustration and description. It is not intended to be exhaustive or to limit the invention to the precise form disclosed. Many modification and variations are possible in light of the above teaching. It is intended that the scope of this invention be limited not by the detailed description but rather by the claims appended hereto.

I claim:

1. A massage device comprising:

an exterior three dimensional frame formed from brackets attached at their ends forming the shape of a cubed box;

support members spanning two sides of said cubed box;

a rectangular frame located within said cubed box, said rectangular frame having rollers movably supported by said support members;

said device provided with reciprocating means, said means causing said rectangular frame to reciprocate on a horizontal plane within said cubed box;

four arms formed of elongated rectangular bars, said bars mounted intermediate their length to a fulcrum shaft secured to said rectangular frame;

said four arms activated by a crank shaft supported by said rectangular frame, said crankshaft having four crank arms, staggered in their positioning with two of said crank arms being 180 degrees out of phase with the remaining two crank arms;

a tension brake means supported by multiple brackets which are attached to said rectangular frame, said brake means being connected to said four arms through a plurality of tension springs which control the drop intensity of said four arms.

2. Device according to claim 1, where said massage arms are encased in a pliable sleeve.

3. Brake means, according to claim 1, comprising;

a tension brake bar supported by said brackets, a tension brake lever attached and supported by said tension brake bar for the raising and lowering of said brake bar, which adjusts said tension springs; a quadrant shaped plate secured onto a quadrant support for the adjustable positioning of said tension brake lever.

4. Device according to claim 1, where said exterior frame is rigidly mounted in an upright position on a first elongated cylindrical pipe structure, said first pipe structure being freely fitted into a second elongated cylindrical pipe, attached to a base, having greater diameter than the first pipe, thus providing the free movement of the exterior frame about its base.

5. An exterior frame, as in claim 4, housing a rigidly attached motor, said motor causes said exterior frame and said first pipe to oscillate, said first pipe being oscillated within said second elongated cylindrical pipe.

* * * * *